US010520239B2

(12) United States Patent
Chezem et al.

(10) Patent No.: US 10,520,239 B2
(45) Date of Patent: Dec. 31, 2019

(54) REFRIGERATOR APPLIANCE AND AIR DUCT THEREFOR

(71) Applicant: Haier US Appliance Solutions, Inc., Wilmington, DE (US)

(72) Inventors: Michael Thomas Chezem, Georgetown, IN (US); Roger Shawn Nelson, Louisville, KY (US); Pat Napier, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 123 days.

(21) Appl. No.: 15/878,508

(22) Filed: Jan. 24, 2018

(65) Prior Publication Data

US 2019/0226748 A1 Jul. 25, 2019

(51) Int. Cl.

| | |
|---|---|
| ***F25D 17/08*** | (2006.01) |
| ***F25D 17/06*** | (2006.01) |
| *F25D 23/06* | (2006.01) |

(52) U.S. Cl.

CPC ..... *F25D 17/08* (2013.01); *F25D 17/065* (2013.01); *F25D 23/06* (2013.01); *F25D 23/065* (2013.01); *F25D 23/067* (2013.01); *F25D 2317/067* (2013.01)

(58) Field of Classification Search

CPC .. F25D 17/08; F25D 2317/067; F25D 17/065; F25D 23/06; F25D 23/065; F25D 23/067

See application file for complete search history.

(56) References Cited

U.S. PATENT DOCUMENTS

| | | | | |
|---|---|---|---|---|
| 3,866,437 | A * | 2/1975 | Spencer | F25D 17/045 62/408 |
| 4,186,945 | A * | 2/1980 | Hahn | F16L 5/022 174/153 G |
| 5,369,963 | A * | 12/1994 | Pickles | F25D 17/045 62/408 |
| 5,979,174 | A * | 11/1999 | Kim | F25D 17/065 62/404 |
| 10,094,610 | B2 * | 10/2018 | Sexton | F25D 17/045 |
| 2017/0108264 | A1 * | 4/2017 | Luo | F25D 17/06 |
| 2018/0363971 | A1 * | 12/2018 | Abeygunawardana | F25D 17/042 |

FOREIGN PATENT DOCUMENTS

| | | | |
|---|---|---|---|
| EP | 2336687 | A1 | 6/2011 |
| KR | 100678677 | B1 | 2/2007 |
| WO | WO2016078894 | A1 | 5/2016 |

* cited by examiner

*Primary Examiner* — Frantz F Jules
*Assistant Examiner* — Lionel Nouketcha
(74) *Attorney, Agent, or Firm* — Dority & Manning, P.A.

(57) ABSTRACT

A refrigerator appliance and air duct are provided herein. The refrigerator appliance may include a cabinet, an internal liner, and an air duct. The internal liner may be positioned within the cabinet and define a chilled chamber. The air duct may include a duct body and a plurality of resilient fingers. The duct body may extend between a first end to a second end. The duct body may define a fluid exchange path between the first end and the second end. The duct body may further define a first fluid opening at the first end in fluid communication with the fluid exchange path. The plurality of resilient fingers may be radially-spaced apart about the fluid opening. The plurality of resilient fingers may extend integrally from the duct body against the internal liner at the first end of the duct body.

20 Claims, 11 Drawing Sheets

REFRIGERATOR APPLIANCE AND AIR DUCT THEREFOR

FIELD OF THE INVENTION

The present subject matter relates generally to refrigerator appliances, and more particularly to air ducts for directing air within a refrigerator appliance.

BACKGROUND OF THE INVENTION

Certain appliances, such as a refrigerator appliance, utilize convection cooling systems for cooling one or more chilled chambers. For instance, a common cooling system for a refrigerator appliance includes an evaporator and an air duct. During operations, the air duct may direct a flow of air across the evaporator and to/from the chilled chamber(s). A convective heat transfer between the flow of air and the evaporator generally serves to cool the flow of air before it is directed to the chilled chamber(s). In some such systems, air is recirculated across the evaporator and to at least one chilled chamber. Through this heat transfer, a chilled chamber may be maintained at the desired temperature. In certain conventional refrigerator appliances, the air duct is positioned within a cabinet of the refrigerator appliance and attached to an internal liner that defines the chilled chamber. Insulation may surround the internal liner or air duct.

Challenges often exist with these conventional appliances. As an example, it may be difficult to construct or maintain a suitable seal between an air duct and an internal liner. Gaps may form between the air duct and the internal liner. During operations, air may thus leak from the air duct (e.g., into an undesired portion of the cabinet), decreasing the efficacy and efficiency of the cooling system. If insulation is placed within the cabinet, it is possible for foam to enter the air duct (e.g., during assembly) and hinder the flow of air through the duct. Some existing systems utilize multi-piece gaskets or O-rings fitted between an air duct and liner. However, these systems may be difficult to assemble and prone to defects. Moreover, these systems may increase the overall cost and complexity of the appliance.

Therefore, there is a need for further improvements to the cooling systems of various appliances. It would be advantageous to provide an air duct or appliance with one or more features to address the above-identified issues. In particular, it would be advantageous to provide an air duct that can easily establish a suitable seal between the air duct and a mating surface.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, an internal liner, and an air duct. The internal liner may be positioned within the cabinet and define a chilled chamber. The air duct may include a duct body and a plurality of resilient fingers. The duct body may extend between a first end to a second end. The duct body may define a fluid exchange path between the first end and the second end. The duct body may further define a first fluid opening at the first end in fluid communication with the fluid exchange path. The plurality of resilient fingers may be radially-spaced apart about the fluid opening. The plurality of resilient fingers may extend integrally from the duct body against the internal liner at the first end of the duct body.

In another exemplary aspect of the present disclosure, an air duct positionable within a refrigerator appliance is provided. The air duct may include a duct body and a plurality of resilient fingers. The duct body may define a fluid exchange path between the first end and the second end. The first fluid opening at the first end in fluid communication with the fluid exchange path. The plurality of resilient fingers may be radially-spaced apart about the fluid opening. The plurality of resilient fingers may extend integrally from the duct body against an internal liner of the refrigerator appliance at the first end of the duct body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
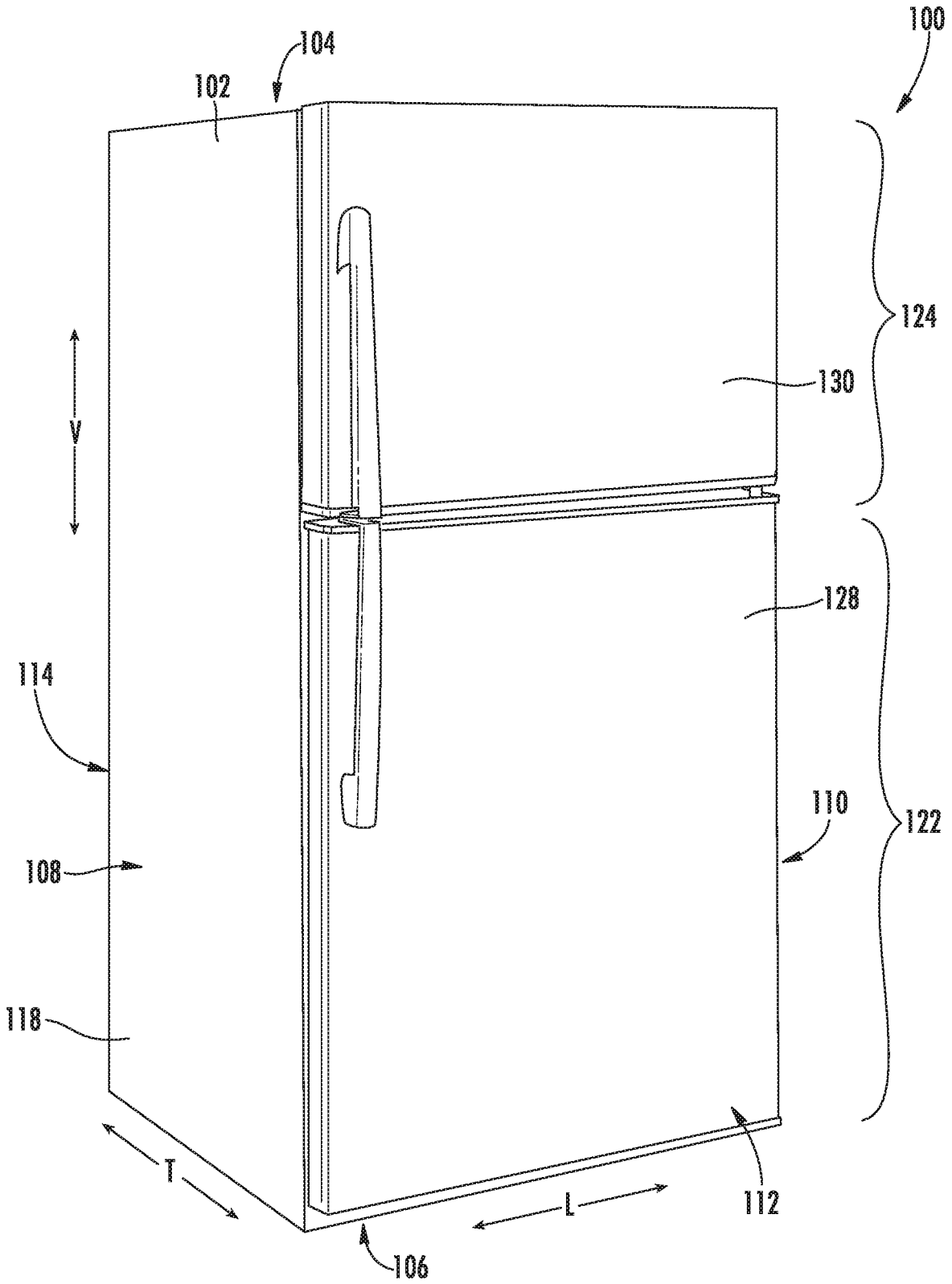
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
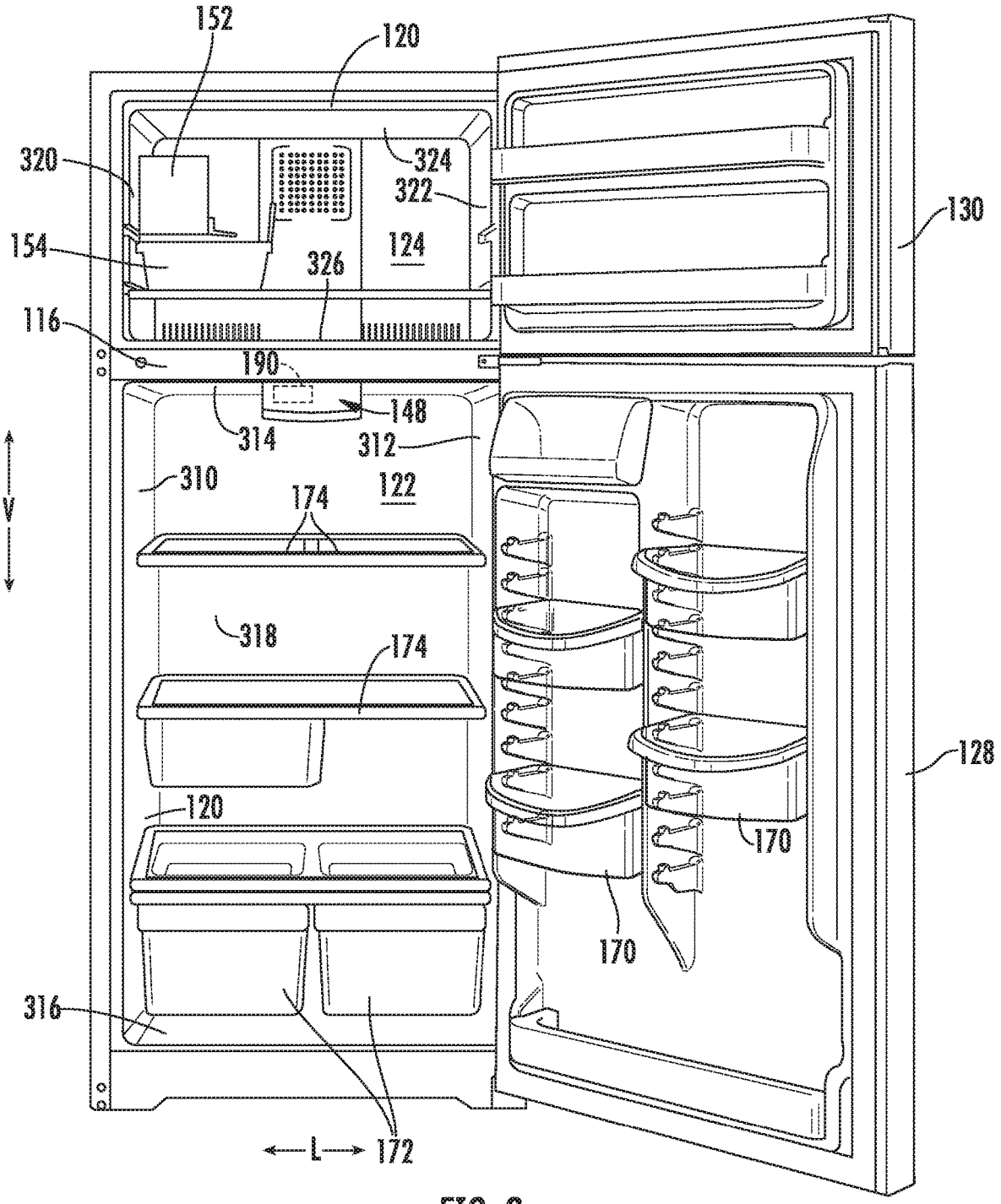
FIG. 2 provides a perspective view of the exemplary refrigerator appliance shown in FIG. 1, wherein a refrigerator door is in an open position according to an example embodiments of the present disclosure.
Figure 3:
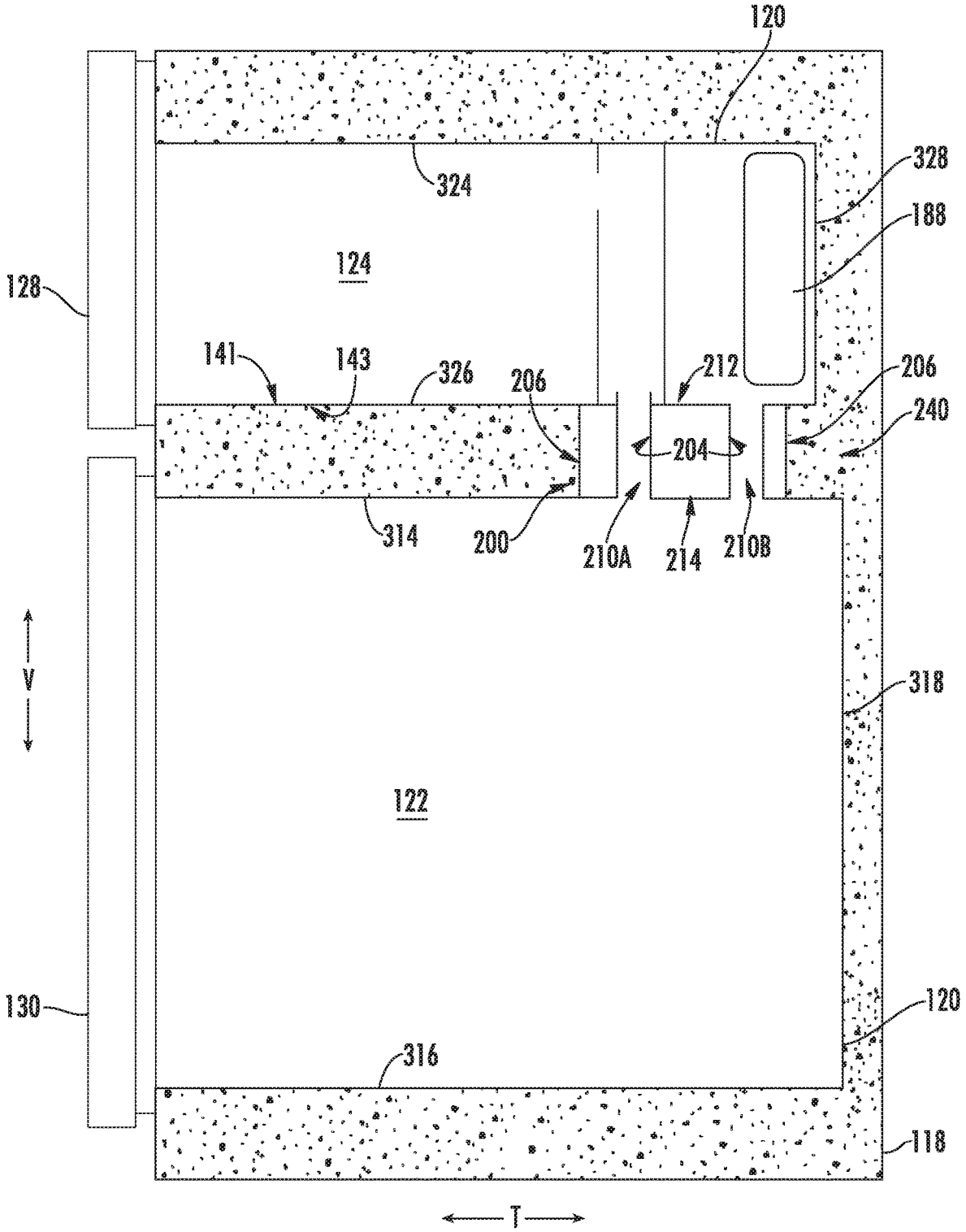
FIG. 3 provides a schematic side view of the exemplary refrigerator appliance of FIG. 1.

Turning to the figures, FIGS. 1 and 2 illustrate perspective views of an exemplary appliance (e.g., a refrigerator appliance 100). FIG. 3 provides a schematic cross-sectional view of refrigerator appliance 100. Refrigerator appliance 100 includes a housing or cabinet 102 having an outer liner 118. As shown, cabinet generally extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

As shown, cabinet 102 generally defines chilled chambers for receipt of food items for storage. In particular, cabinet 102 defines a fresh food chamber 122 proximal to bottom 106 of cabinet 102 and a freezer chamber 124 arranged proximal to top 104 of cabinet 102. Freezer chamber 124 is spaced apart from fresh food chamber 122 along the vertical direction V. As such, refrigerator appliance 100 is generally referred to as a top mount refrigerator. It is recognized, however, that the benefits of the present disclosure apply to other types and styles of refrigerator appliances such as, for example, a bottom mount refrigerator appliance or a side-by-side style refrigerator appliance. Consequently, the description set forth herein is for illustrative purposes only and is not intended to be limiting in any aspect to any particular appliance configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages, solid food items, etc.) and may assist with organizing such food items. As an example, drawers 172 can receive fresh food items (e.g., vegetables, fruits, or cheeses) and increase the useful life of such fresh food items. In some embodiments, a lateral mullion 116 is positioned within cabinet 102 and separating freezer chamber 124 and the fresh food chamber 122 along a vertical direction V.

A refrigerator door 128 is rotatably hinged to an edge of cabinet 102 for selectively accessing fresh food chamber 122 and extending across at least a portion of fresh food chamber 122. In addition, a freezer door 130 is rotatably hinged above refrigerator door 128 for selectively accessing freezer chamber 124 and extending across at least a portion of freezer chamber 124. Refrigerator door 128 and freezer door 130 are each shown in the closed position in FIG. 1 (i.e., a first closed position corresponding to door 128, and a second closed position corresponding to door 130). In FIG. 2, refrigerator door 128 and freezer door 130 are each shown in the closed position (i.e., a first open position corresponding to door 128, and a second open position corresponding to door 130)

Operation of the refrigerator appliance 100 can be generally controlled or regulated by a controller 190. In some embodiments, controller 190 is operably coupled to a user interface panel 148 (e.g., mounted within fresh food chamber 122) or various other components of refrigerator appliance 100. In some embodiments, user interface panel 148 provides selections for user manipulation of the operation of refrigerator appliance 100. As an example, user interface panel 148 may provide for selections of temperature settings or specific modes of operation. In response to one or more input signals (e.g., from user manipulation of user interface panel 148 or one or more sensor signals), controller 190 may operate various components of the refrigerator appliance 100 according to the current mode of operation.

Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100. The memory may be a separate component from the processor or may be included onboard within the processor. Alternatively, controller 190 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as for example within cabinet, a door 128 or 130, etc. Input/output ("I/O") signals may be routed between controller 190 and various operational components of refrigerator appliance 100. For example, user interface panel 148 may be operably coupled to controller 190 via one or more signal lines or shared communication busses.

As illustrated, controller 190 may be operably coupled to the various components of dispensing assembly 140 and may control operation of the various components. For example, the various valves, switches, etc. may be actuatable based on commands from the controller 190. As discussed, interface panel 148 may additionally be operably coupled to the controller 190. Thus, the various operations may occur based on user input or automatically through controller 190 instruction.

As shown, an ice making assembly or icemaker 152 may be positioned or mounted within freezer chamber 124, along with an optional storage bin 154. Icemaker 152 may be any suitable assembly for generating ice from liquid water, such as a rigid cube, soft-ice, or nugget ice making assembly. Ice storage bin 154 may be positioned to receive or store ice from icemaker 152. In the illustrated embodiments, ice storage bin 154 is positioned below icemaker 152 and receives ice therefrom.

An internal liner 120 generally defines fresh food chamber 122 and freezer chamber 124. Specifically, an inner surface 141 of internal liner 120 may define one or both of fresh food chamber 122 and freezer chamber 124. An opposite outer surface 143 of internal liner 120 may face away from inner surface 143 and the respective fresh food chamber 122 or freezer chamber 124. Internal liner 120 may be formed from a single continuous integral component or, alternatively, from multiple connected pieces.

In the illustrated embodiments, internal liner 120 includes a plurality of walls defining chambers 122, 124. Specifically, internal liner 120 includes a first and a second fresh food sidewall (310 and 312) spaced apart along the lateral direction L, as well as an upper and a lower fresh food wall (314 and 316) spaced apart along the vertical direction V. A rear fresh food wall 318 may join upper fresh food wall 314, lower fresh food wall 316, and fresh food sidewalls 310, 312 to define an internal extreme of fresh food chamber 122 along the transverse direction T (i.e., a point or plane of fresh food chamber 122 most proximal to rear side 114 of cabinet 102). Rear fresh food wall 318 may further be positioned opposite an opening defined between the transverse fresh food walls 310, 312, 314, 316 and selectively covered by door 128. Internal liner 120 may further include a first and a second freezer sidewall (320 and 322) spaced apart along the lateral direction L, as well as an upper and a lower freezer wall (324 and 326) spaced apart along the vertical direction V. A rear freezer wall 328 may join upper freezer wall 324, lower freezer wall 326, and freezer sidewalls 320, 322 to define an internal extreme of freezer chamber 124 along the transverse direction T (i.e., a point or plane of freezer chamber 124 most proximal to rear side 114 of cabinet 102). Rear freezer wall 328 may further be positioned opposite an opening defined between the transverse freezer walls 320, 322, 324, 326 and selectively covered by door 130.

As shown especially in FIG. 3, when assembled, internal liner 120 may be assembled at least partially within outer liner 118. Insulation (e.g., foam insulation) may be positioned between internal liner 120 and outer liner 118 along outer surface 143. Additionally or alternatively, insulation may be positioned along outer surface 143 between fresh food chamber 122 and freezer chamber 124. As will be discussed in greater detail below, an air duct 200 positioned within cabinet 102 defines one or more air or fluid paths 210A, 210B permitting fluid exchange between fresh food chamber 122 and freezer chamber 124. During operation of refrigerator appliance 100, fresh food chamber 122 may thus be in fluid communication with freezer chamber 124.

Figure 7:
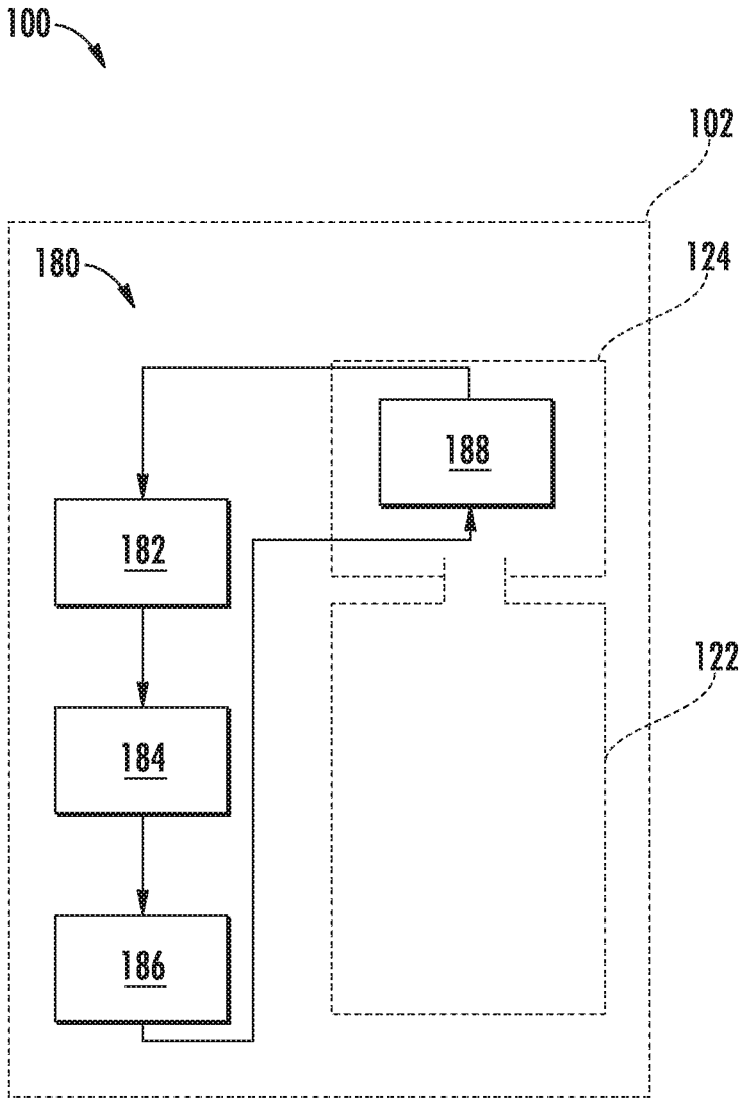
FIG. 7 provides a cross-sectional side view of a refrigerator appliance, including a sealed cooling system, according to example embodiments of the present disclosure.

Turning briefly to FIG. 7, a schematic view of certain components of a sealed cooling system 180 for refrigerator appliance 100 is provided. As may be seen in FIG. 7, refrigerator appliance 100 includes a sealed cooling system 180 for executing a vapor compression cycle for cooling air within refrigerator appliance 100 (e.g., within fresh food chamber 122 and freezer chamber 124). Sealed cooling system 180 includes a compressor 182, a condenser 184, an expansion device 186, and an evaporator 188 connected in fluid series and charged with a refrigerant. As will be understood by those skilled in the art, sealed cooling system 180 may include additional or fewer components. For example, sealed cooling system 180 may include multiple discrete evaporators positioned separate locations within cabinet 102.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange (e.g., with ambient air) takes place so as to cool the refrigerant and cause the refrigerant to condense to a liquid state.

Expansion device 186 (e.g., a valve, capillary tube, or other restriction device) receives liquid refrigerant from condenser 184. From expansion device 186, the liquid refrigerant enters evaporator 188. In some embodiments, such as the embodiment of FIG. 7, evaporator 188 is positioned within freezer chamber 124. Upon exiting expansion device 186 and entering evaporator 188, the liquid refrigerant drops in pressure and vaporizes. Due to the pressure drop and phase change of the refrigerant, evaporator 188 is cool relative to freezer and fresh food chambers 124 and 122 of refrigerator appliance 100. As such, cooled air is produced and refrigerates freezer and fresh food chambers 124 and 122 of refrigerator appliance 100. Air and heat may be exchanged through fluid path 210A or 210B connecting freezer chamber 124 to fresh food chamber 124. Thus, evaporator 188 acts as a heat exchanger that transfers heat from air passing over evaporator 188 to refrigerant flowing through evaporator 188. In some embodiments, an air handler (not pictured), such as a fan or blower, is provided adjacent to evaporator 188. For instance, an air handler may be provided within freezer chamber 124 to motivate air across evaporator 188 in a forced convection airflow. Additionally or alternatively, air may flow between freezer chamber 124 and fresh food chamber 122 via a natural convection airflow (i.e., according to the difference in density between relatively cold air and relatively hot air).

Turning now to FIGS. 3 through 6, various views of an air duct 200 mounted within refrigerator appliance 100 according to exemplary embodiments are provided. As shown, air duct 200 generally includes a duct body 202 extending in an axial direction A (e.g., along the vertical direction V when mounted within refrigerator appliance 100) between a first end (e.g., upper end 212) and a second end (e.g., lower end 214). Between upper end 212 and lower end 214, the duct body 202 defines one or more fluid exchange paths 210A, 210B along corresponding inner surface(s) 204. During use, a fluid (e.g., air) may be permitted to pass through duct body 202 via fluid exchange paths 210A, 210B. Thus, multiple openings (e.g., a first fluid opening 216A and a second fluid opening 218A) are defined by duct body 202 in fluid communication with a corresponding fluid exchange path (e.g., fluid exchange path 210A). The openings (e.g., 216A and 216B) thus permit air to enter/exhaust one portion of duct body 202 and exhaust/enter another discrete portion of duct body 202.

In the illustrated embodiments of FIGS. 3 through 6, air duct 200 is positioned between fresh food chamber 122 and freezer chamber 124. Specifically, air duct 200 is positioned within the space defined between the portions of internal liner 120 defining fresh food chamber 122 and freezer chamber 124, respectively. Air duct 200 may facilitate physical separation (e.g., along the vertical direction V) and fluid communication between the two chambers 122, 124. When assembled, upper end 212 of duct body 202 is positioned proximal to freezer chamber 124 (i.e., distal to fresh food chamber 122 relative to lower end 214). Conversely, lower end 214 of duct body 202 is positioned proximal to fresh food chamber 122 (i.e., distal to freezer chamber 124 relative to upper end 212).

As noted above, air duct 200 may permit fluid communication between freezer chamber 124 and fresh food chamber 122 through fluid exchange path 210A or 210B. A first fluid opening 216A or 216B may be defined at upper end 212 (e.g., in fluid communication with freezer chamber 124). A second fluid opening 218A or 218B may be defined at lower end 214 (e.g., in fluid communication with fresh food chamber 122). Corresponding liner openings are defined through internal liner 120 and aligned (e.g., vertically aligned) with one or more of the fluid openings 216A, 216B, 218A, 218B. For instance, a discrete liner opening 220A may be defined through lower freezer wall 326 in axial alignment with a corresponding first fluid opening 216B. Another discrete liner opening 220A may be defined through lower freezer wall 326 in axial alignment with a corresponding first fluid opening 216A. Similarly, a discrete liner opening 220B may be defined through the upper fresh food wall 314 in axial alignment with a corresponding second fluid opening 218B. Yet another discrete liner opening 220B may be defined through upper fresh food wall 314 in axial alignment with a corresponding second fluid opening 218A.

A single fluid exchange path 210A or 210B may thus generally extend along the axial direction A between the fluid openings (e.g., between one pair of openings 216A and 218A or, alternatively, between another pair of openings 216B and 218B). First instance, fluid exchange path 210A or 210B may be defined in parallel to the axial direction A or, alternatively, at an angle (e.g., non-parallel and non-perpendicular) relative to the axial direction A. Moreover, although a fluid exchange path 210A or 210B is illustrated as being substantially linear, it is recognized that alternative embodiments may include a fluid exchange path 210A or 210B formed according to another suitable path shape (e.g., curved, serpentine, helical, etc.).

As noted above, during use, relatively cool air flowed across evaporator 188 within freezer chamber 124 may pass (e.g., via natural or forced convection airflow) to fresh food chamber 122 through air duct 200. Additionally or alternatively, relatively warm air within fresh food chamber 122 may pass to freezer chamber 124 (e.g., via natural or forced convection airflow).

In some embodiments, air duct 200 is formed as a bi-directional duct permitting multiple simultaneous or discrete airflows. For instance, duct body 202 may define two discrete fluid exchange paths 210A, 210B (e.g., a first fluid exchange path 210A and a second fluid exchange path 210A). As shown, the fluid exchange paths 210A, 210B may be defined in fluid parallel. In other words, first fluid exchange path 210A may have a first fluid opening 216A that is parallel to a first fluid opening 216B of second fluid exchange path 210B. Similarly, first fluid exchange path 210A may have a second fluid opening 218A that is parallel to a second fluid opening 218B of second fluid exchange path 210B.

In terms of geometry, each fluid exchange path 210A and 210B may be directionally parallel (e.g., parallel to the axial direction A) or, alternatively, non-parallel (e.g., at separate unique angles relative to the axial direction A). In some embodiments, both first fluid openings 216A, 216B are defined at upper end 212, and both second fluid openings 218A, 218B are defined at lower end 214. First fluid openings 216A, 216B may be spaced apart from each other along a radial direction R (e.g., such that a solid, non-permeable portion of duct body 202 separates first fluid openings 216A, 216B perpendicular to the axial direction A). Second fluid openings 218A, 218B may be spaced apart from each other (e.g., such that a solid, non-permeable portion of duct body 202 separates first fluid openings 216A, 216B perpendicular to the axial direction A). The radial spacing between the first fluid openings 216A, 216B and the second fluid openings 218A, 218B may be equal (e.g., in embodiments wherein the paths 210A and 210B are directionally parallel). Alternatively, the radial spacing between the first fluid openings 216A, 216B and the second fluid openings 218A, 218B may be unique (e.g., in embodiments wherein the paths 210A and 210B are directionally non-parallel).

Figure 4:
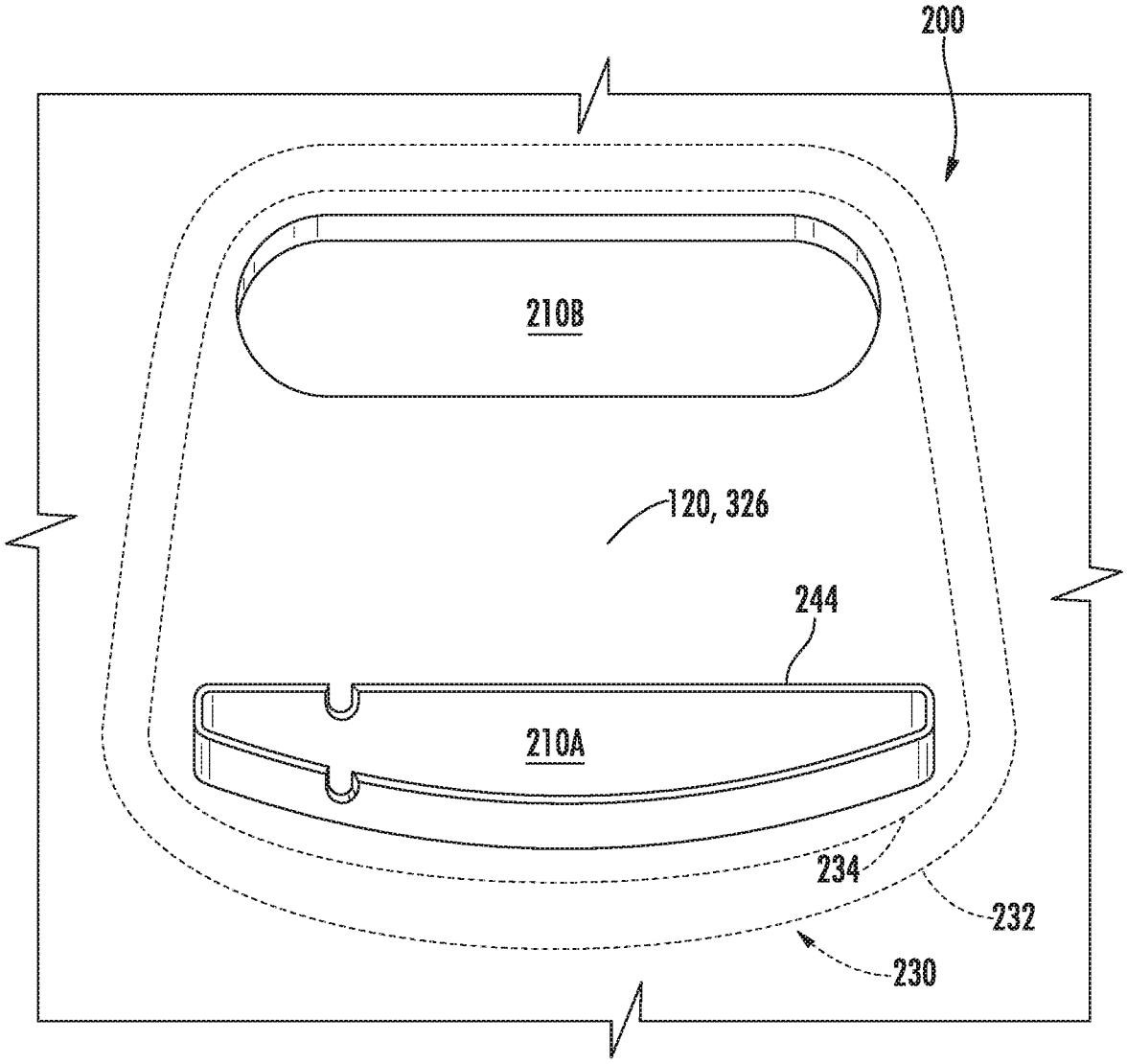
FIG. 4 provides a perspective top view of an air duct mounted within a refrigerator appliance according to exemplary embodiments of the present disclosure.
Figure 5:
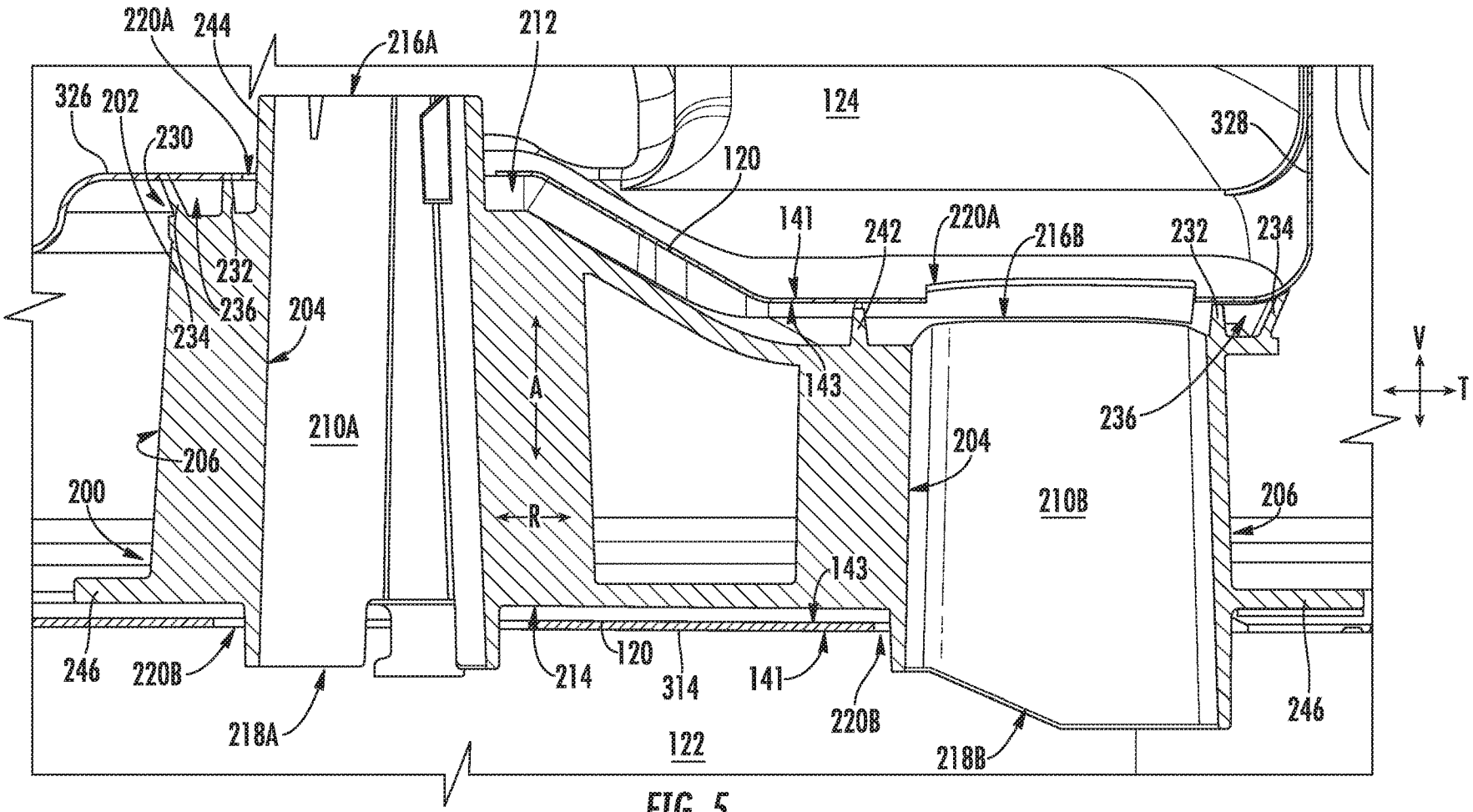
FIG. 5 provides a cross-sectional side view of an air duct mounted within a refrigerator appliance according to exemplary embodiments of the present disclosure.
Figure 6:
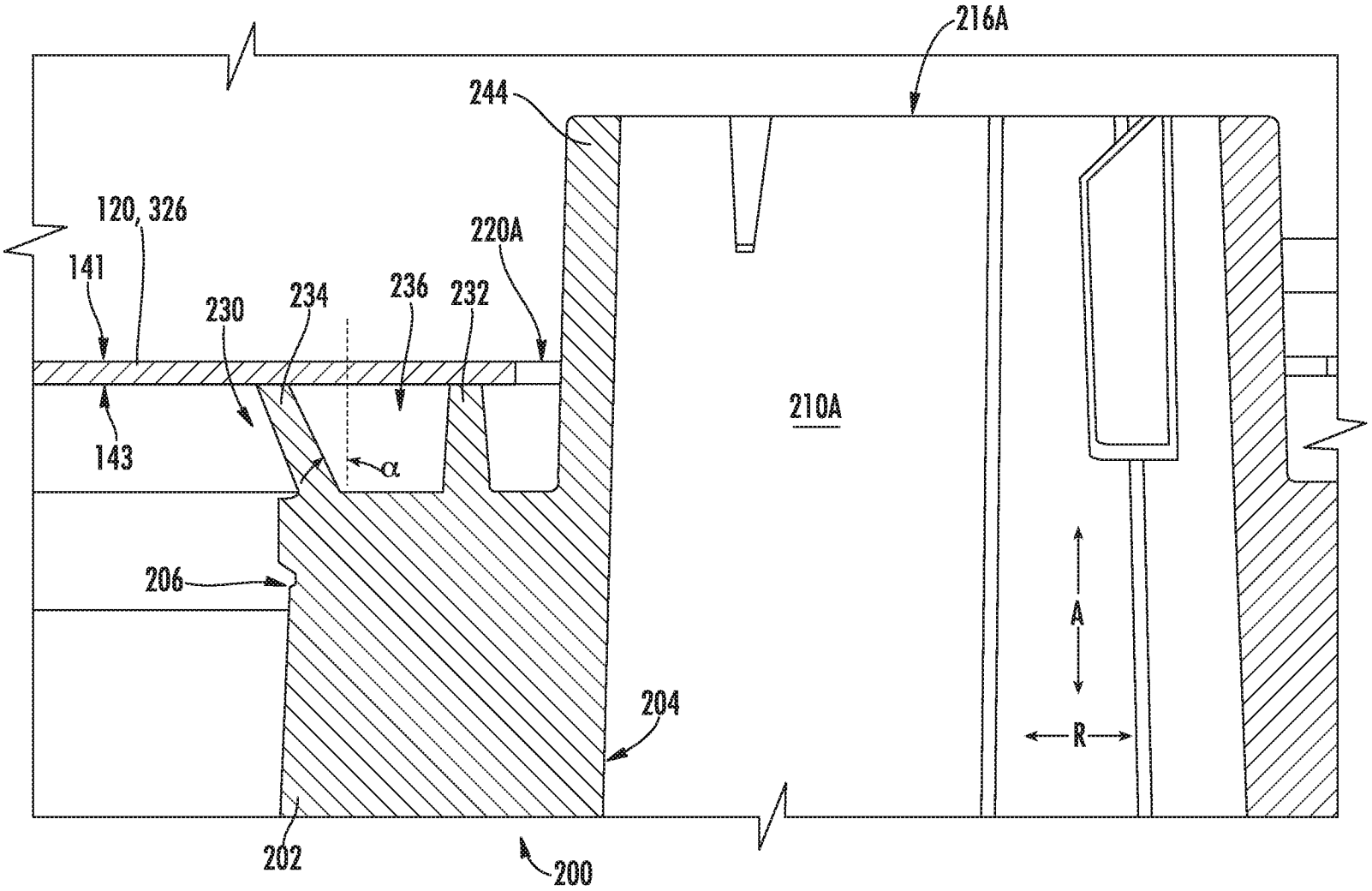
FIG. 6 provides a magnified cross-sectional side view of a portion of the exemplary air duct of FIG. 5.

Turning especially to FIGS. 4 through 6, when assembled, one or more portions of air duct 200 are provided in contact (e.g., direct or indirect contact) with a portion of internal liner 120. For instance, air duct 200 may include a plurality of resilient fingers 230 that extend from duct body 202 (e.g., at the upper end 212) to rest against a portion of the outer surface 143 of internal liner 120. In the illustrated embodiments, fingers 230 extend from duct body 202 at the upper end 212 and directly contact the outer surface 143 of internal liner 120 below freezer chamber 124. In other words, fingers 230 directly contact the lower freezer wall 326.

Each of the plurality of fingers 230 is radially-spaced apart about the first fluid opening(s) 216A, 216B (e.g., along the radial direction R). As a result, a radial space 236 is defined between adjacent fingers 230 (e.g., a radially-innermost finger 232 and a radially-outermost finger 234). Fingers 230, including radial space 236, may extend continuously along a perimeter of air duct 200 (e.g., at upper end 212). In some embodiments, such as those shown in FIGS. 4 through 6, fingers 230 extend about multiple fluid openings 216A, 216B. For instance, fingers 230 may extend uninterrupted about the first fluid openings 216A, 216B at upper end 212. The fingers 230 may extend about fluid openings collectively (e.g., as pictured), such that the fingers 230 together extend about and radially bound multiple first fluid openings 216A, 216B. Alternatively, the fingers 230 may extend about first fluid openings 216A or 216B individually, such that fingers 230 together extend about and radially bound only a single first fluid opening 216A or 216B.

In some embodiments, at least one finger (e.g., radially-outermost finger 234) of the plurality of resilient fingers 230 extends to the internal liner 120 at a non-parallel angle relative to the axial direction A (e.g., non-orthogonal relative to a planar contact segment of outer surface 143 of the internal liner 120). For instance, the angled finger (e.g., radially-outermost finger 234) may be flared outward relative to the duct body 202 (e.g., away from the axial direction A). In some embodiments, the radially-outermost finger 234 defines an acute angle $\alpha$ relative to the axial direction A. The acute angle $\alpha$ may remain constant (e.g., along the perimeter of duct body 202) or, alternatively, may vary along the perimeter. Contact with internal liner 120 may further deflect the radially-outermost finger 234 away from the axial direction A (e.g., during assembly). Additionally or alternatively, a radially-outermost finger 234 may contact a non-planar curved portion of internal liner 120 (e.g., at a corner or transition portion connecting walls 326 and 328).

In additional or alternative embodiments, another finger (e.g., radially-innermost finger 232) of the plurality of resilient fingers 230 extends to the internal liner 120 at a substantially parallel angle relative to the axial direction A (e.g., substantially perpendicular relative to a planar segment of outer surface 143). For instance, the non-angled finger (e.g., radially-innermost finger 232) may be a linear member parallel that is to the axial direction A and extends vertically from duct body 202.

As shown, especially at FIGS. 5 and 6, fingers 230 extend integrally from duct body 202 (e.g., as a unitary or monolithic member with duct body 202). In some embodiments, fingers 230 and duct body 202 include (e.g., are formed of) a suitable polymer, such as polypropylene or another polymer material having similar characteristics. Moreover, during assembly (e.g., subsequent to placement of the duct body 202 within cabinet 102), fingers 230 or duct body 202 may be heated to a temperature above about 115° Fahrenheit (e.g., within an environment of about 130° Fahrenheit such that fingers 230 or duct body 202 reach a temperature between about 115° Fahrenheit and about 125° Fahrenheit). Notably, the described fingers 230 and duct body 202 may facilitate efficient alignment and installation of air duct 200 (e.g., between freezer chamber 124 and fresh food chamber 122).

As shown, duct body 202 defines an outer surface 206 opposite the fluid exchange path 210A or 210B (i.e., opposite inner surfaces 204). In some embodiments, a foam insulation 240 is sprayed or flowed into the surrounding portion of cabinet 102 about internal liner 120. When assembled, foam insulation 240 may be between the internal liner 120 and the cabinet 102 against the outer surface 206 of the duct body 202. During and after assembly, fingers 230 contacting internal liner 120 may advantageously seal liner openings 220A and corresponding fluid openings 216A, 216B from the surrounding environment of cabinet 102 (FIG. 3). Advantageously, insulation foam may be flowed into cabinet 102 outside of chilled chambers 122, 124 while fingers 230 prevent such insulation foam from passing into air duct 200 or chilled chambers 122, 124.

In certain embodiments, such as those shown in FIGS. 5 and 6, air duct 200 includes an intermediate wall 242 that extends from duct body 202 (e.g., in the axial direction A). For instance, intermediate wall 242 may extend from duct body 202 toward the lower freezer wall 326 at upper end 212. Moreover, intermediate wall 242 may be positioned radially-inward from the plurality of resilient fingers 230 such that the plurality of fingers 230 surrounds intermediate wall 242. As shown intermediate wall 242 may be positioned between first fluid openings 216A, 216B (e.g., in the radial direction R). During use, air from one internal liner opening may thus be restricted from flowing radially to a non-corresponding first fluid opening and fluid exchange path. For instance, air from the liner opening 220A corresponding to first fluid opening 216B may be restricted from flowing radially to first fluid opening 216A and fluid exchange path 210A.

In additional or alternative embodiments, duct body 202 includes a raised collar 244 extending about a corresponding fluid opening (e.g., first fluid opening 216A). For instance, raised collar 244 may extend from duct body 202 toward internal liner 120 at the upper end 212. Optionally, raised collar 244 may extend through internal liner 120 (e.g., through a liner opening 220A into freezer chamber 124). Moreover, raised collar 244 may be positioned radially-inward from the plurality of resilient fingers 230 such that the plurality of fingers 230 surrounds raised collar 244. During use, air from a corresponding fluid path (e.g., fluid exchange path 210A) may thus be restricted from flowing radially to a non-corresponding liner opening (e.g., liner opening 220A corresponding to first fluid opening 216).

In further additional or alterative embodiments, a portion of air duct 200 is attached to internal liner 120 by a suitable mechanical or adhesive member. For instance, lower end 214 may include a radial flange 246 extending radially outward from duct body 202. Radial flange 246 may rest on an outer surface 143 of internal liner 120 (e.g., upper fresh food wall 314) opposite the plurality of fingers 230. Additionally or alternatively, a suitable adhesive may bond radial flange 246 to internal liner 120.

Figure 8:
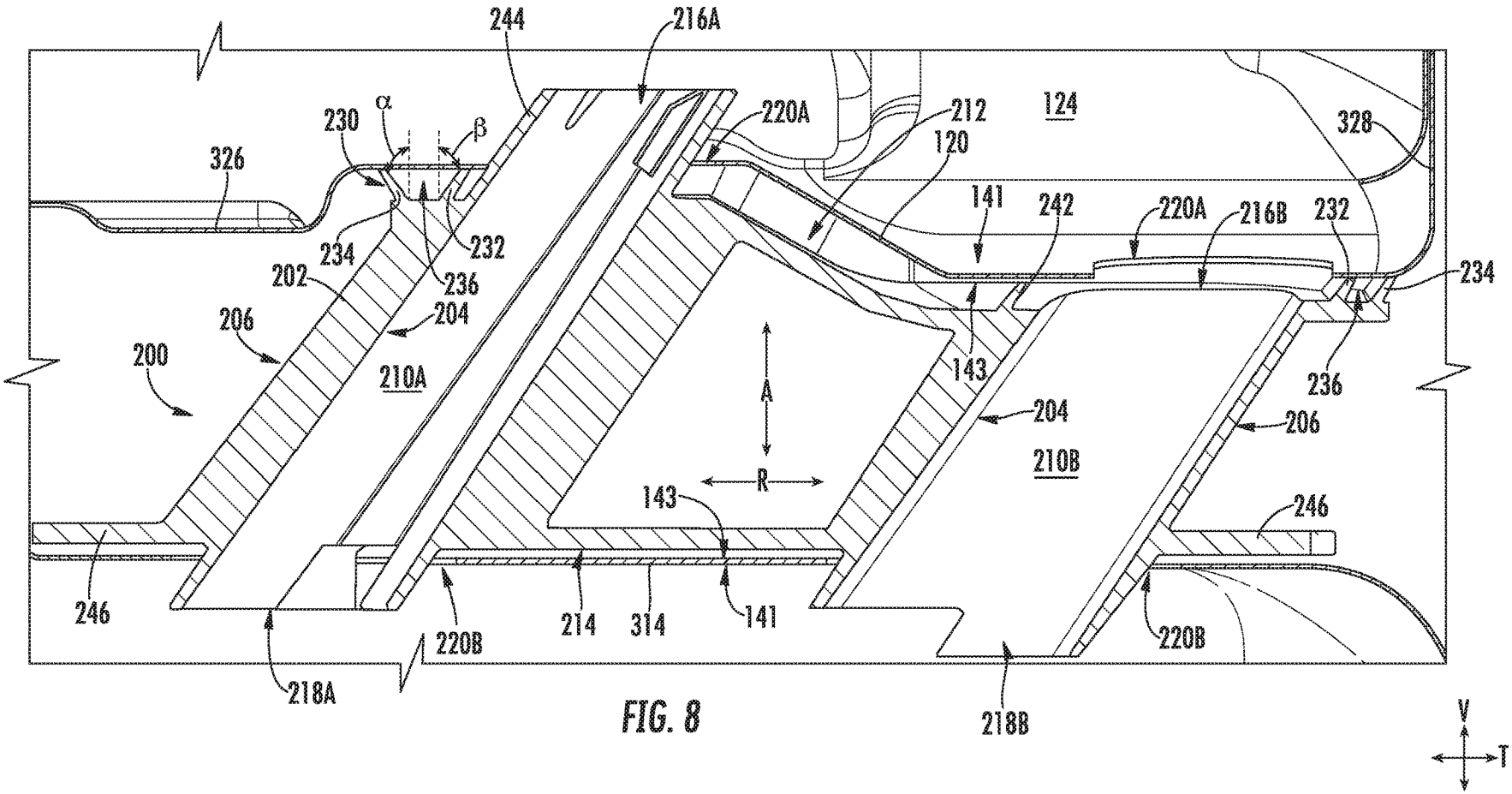
FIG. 8 provides a cross-sectional side view of an air duct mounted within a refrigerator appliance according to exemplary embodiments of the present disclosure.

Turning now to FIG. 8, additional exemplary embodiments of air duct 200 are illustrated. It is understood that the exemplary embodiments of FIG. 8 may include some or all of the above-described features of the exemplary embodiments of FIGS. 3 through 7, except as otherwise indicated. For instance, fluid exchange paths 210A, 210B may be defined such that the fluid exchange paths 210A, 210B are each non-parallel to the axial direction (e.g., paths 210A, 210B each extend at an angle that is note parallel to the axial direction A).

As described above, at least one finger (e.g., radially-outermost finger 234) of the plurality of fingers 230 may extend to the internal liner 120 at a non-parallel angle (e.g., angle $\alpha$) relative to the axial direction A. Additionally or alternatively, another at least one finger (e.g., radially-innermost finger 232) of the plurality of fingers 230 may extend to the internal liner 120 at a unique non-parallel angle relative to the axial direction A. For instance, the radially-innermost finger 232 may be flared inward relative to the duct body 202 (e.g., toward the axial direction A). Moreover, the radially-innermost finger 232 may define an acute angle $\beta$ relative to the axial direction A—the acute angle $\beta$ being directed toward fluid openings 216A, 21B. The acute angle $\beta$ may remain constant (e.g., along the perimeter of duct body 202) or, alternatively, may vary along the perimeter. In certain embodiments wherein the acute angle $\beta$ varies, the angled finger 232 may transition from one angle that is directed toward the fluid openings 216A, 21B to another angle that is directed away from fluid openings 216A, 218B, as shown in FIG. 8. Contact with internal liner 120 may further deflect the radially-innermost finger 232 toward or away from the axial direction A (e.g., during assembly and according to the pre-assembly deflection).

Figure 9:
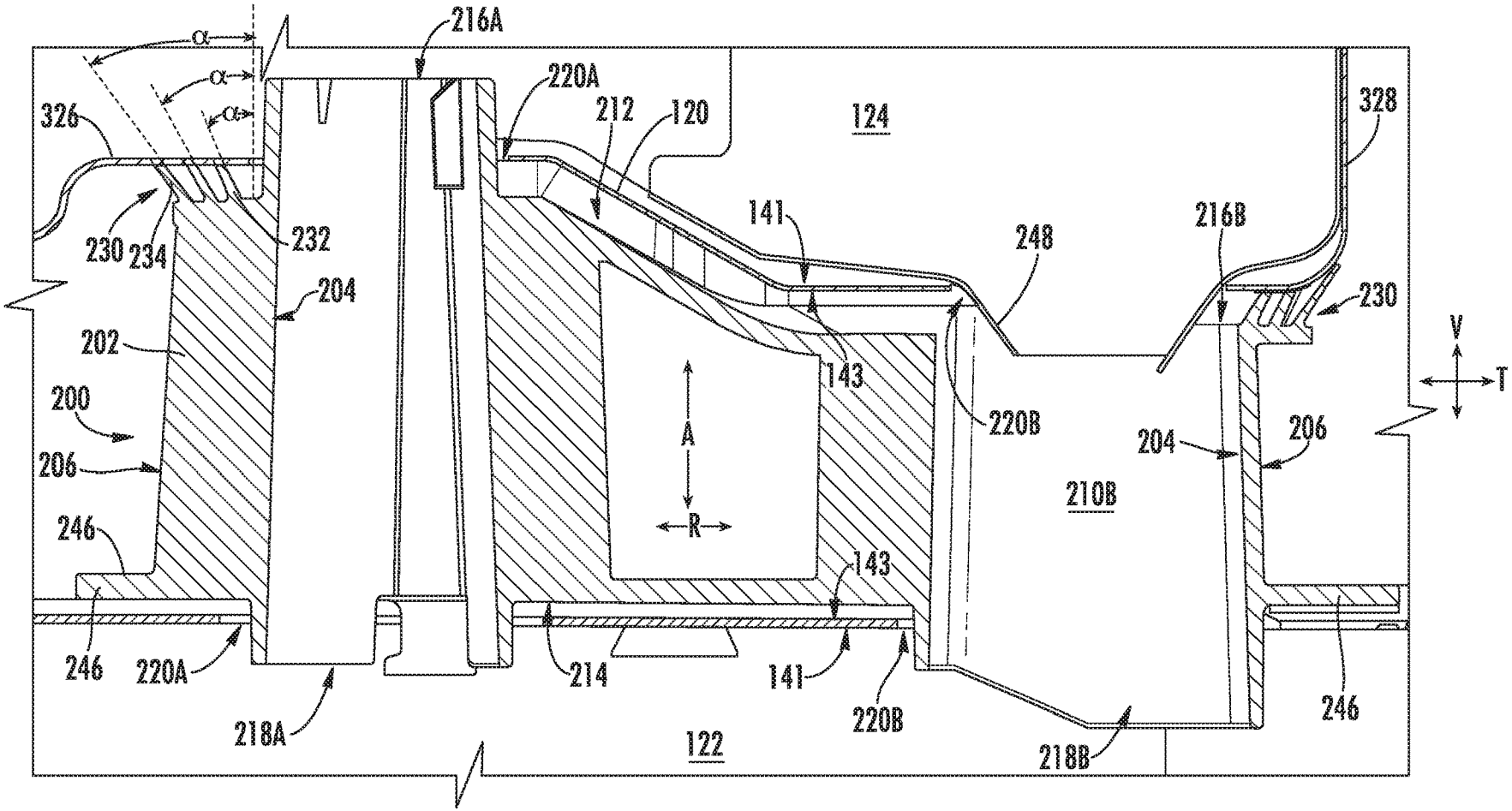
FIG. 9 provides a cross-sectional side view of an air duct mounted within a refrigerator appliance according to exemplary embodiments of the present disclosure.
Figure 10:
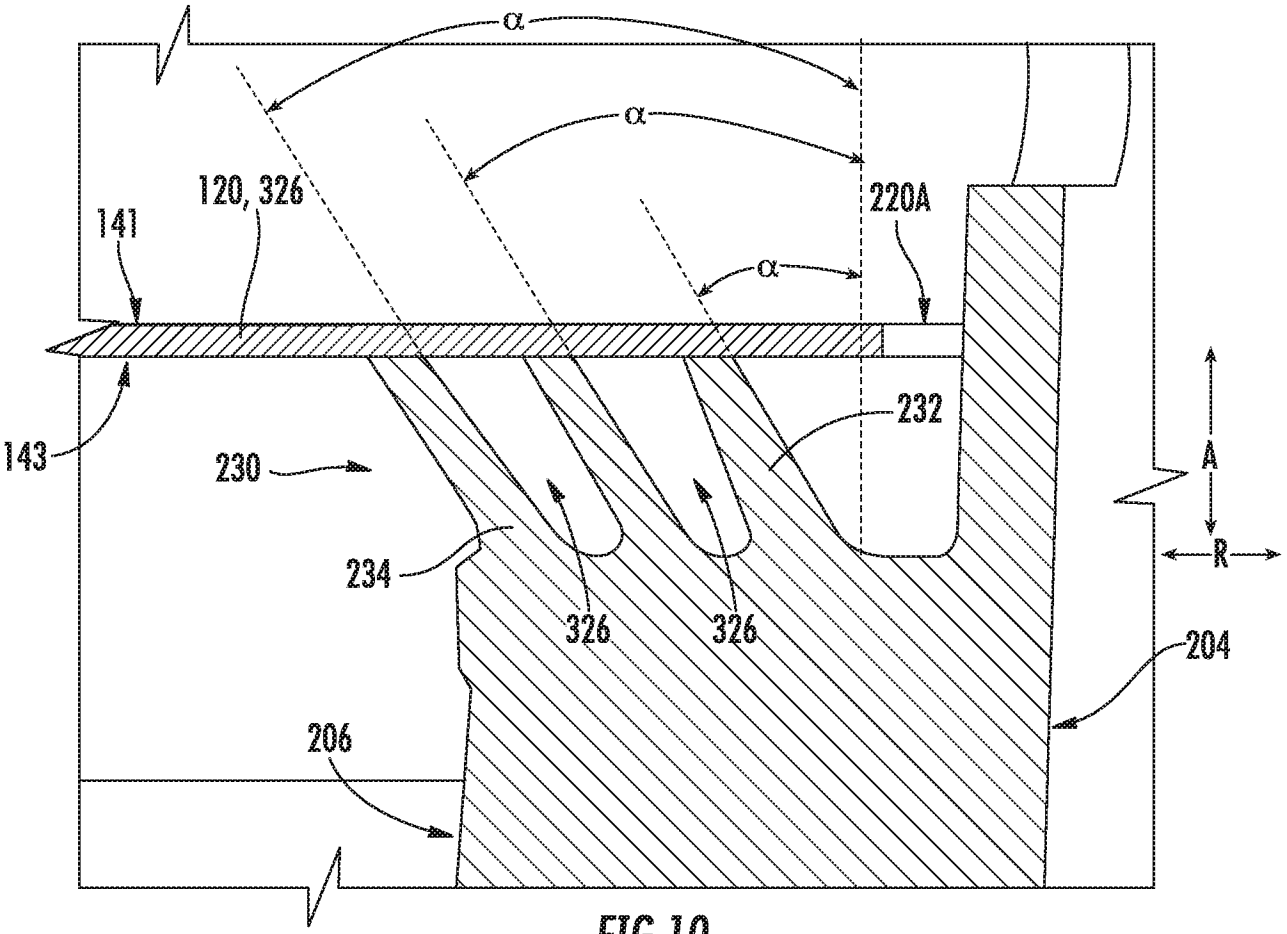
FIG. 10 provides a magnified cross-sectional side view of a portion of the exemplary air duct of FIG. 9.
Figure 11:
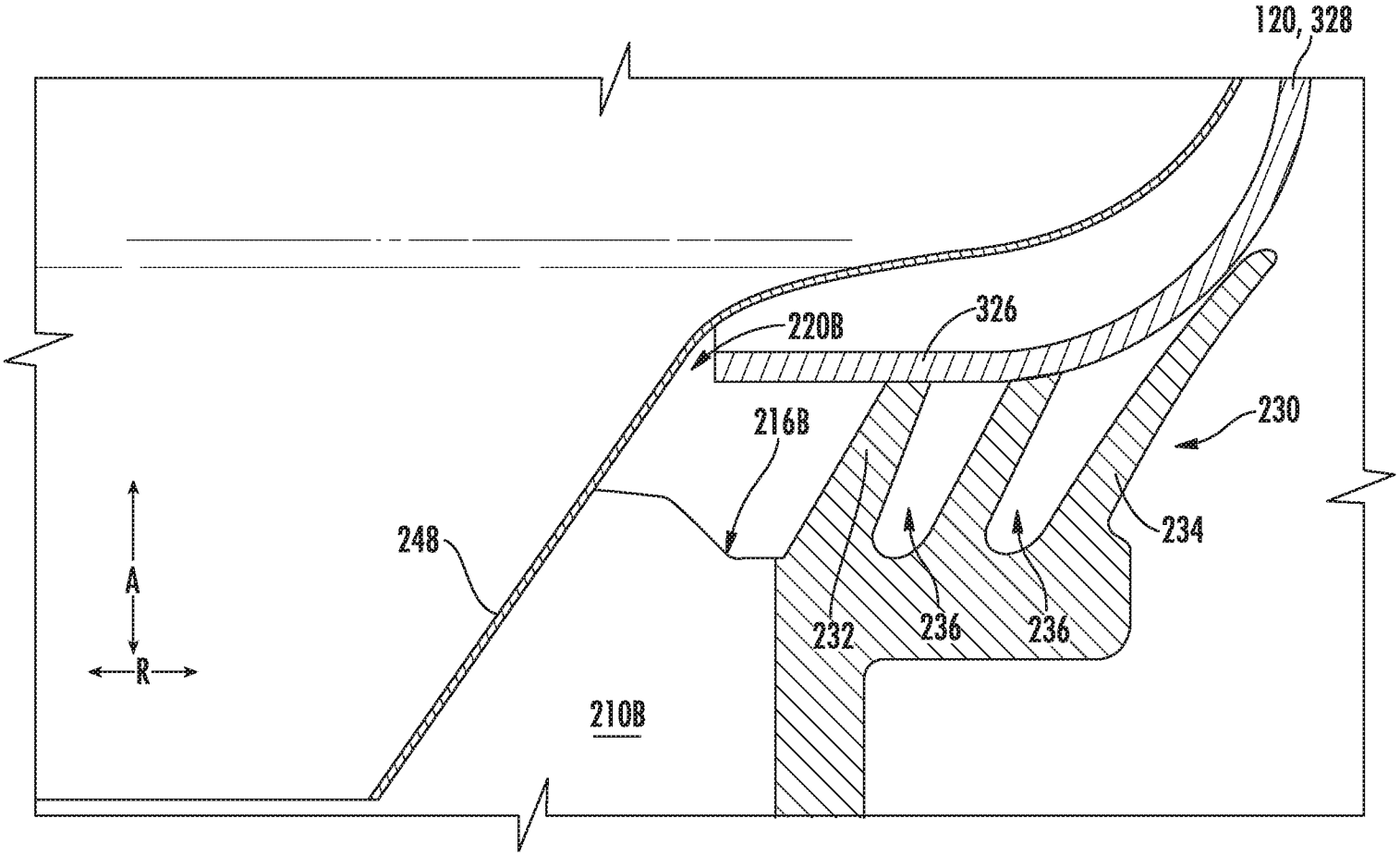
FIG. 11 provides another magnified cross-sectional side view of another portion of the exemplary air duct of FIG. 9.

Turning now to FIGS. 9 through 11, further additional exemplary embodiments of air duct 200 are illustrated. It is understood that the exemplary embodiments of FIGS. 9 and 10 may include some or all of the above-described features of the exemplary embodiments of FIGS. 3 through 8, except as otherwise indicated. For instance, in some embodiments, air duct 200 includes three or more resilient fingers 230. Optionally, each of the plurality of fingers 230 may extend to the internal liner 120 at a non-parallel angle $\alpha$ relative to the axial direction A. For instance, each of the plurality of fingers 230 may extend at an identical acute angle relative to the axial direction A—the acute angle being directed away from fluid openings 216A, 21B. Alternatively, each of the plurality of fingers 230 may extend at a unique acute angle relative to the axial direction A—each unique acute angle being directed away from fluid openings 216A, 21B. The acute angle(s) may remain constant (e.g., along the perimeter of duct body 202) or, alternatively, may vary along the perimeter. Contact with internal liner 120 may further deflect the radially-outermost finger 234 away from the axial direction A (e.g., during assembly). Moreover, as illustrated especially in FIG. 11, a radially-outermost finger 234 may contact a non-planar curved portion of internal liner 120 (e.g., at a corner or transition portion connecting walls 326 and 328).

In certain embodiments, such as those shown in FIGS. 9 through 11, refrigerator appliance 100 includes a drip pan 148 forming a tapered nozzle that extends into a corresponding liner opening 220A (e.g., in the axial direction A). The tapered nozzle of the drip pan 148 may be positioned below the evaporator 188 (FIG. 7) to guide condensation therefrom into the corresponding fluid exchange path 210B.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

an internal liner positioned within the cabinet, the internal liner defining a chilled chamber; and an air duct comprising a duct body extending between a first end to a second end, the duct body defining a fluid exchange path between the first end and the second end, the duct body further defining a plurality of first fluid openings at the first end in fluid communication with the fluid exchange path, and a plurality of resilient fingers radially-spaced apart about the plurality of first fluid openings, the plurality of resilient fingers extending integrally from the duct body, wherein the plurality of resilient fingers extend against an outer surface of the internal liner at the first end of the duct body, wherein the outer surface is defined outside of the chilled chamber, wherein the plurality of resilient fingers are positioned radially outward from and completely surround the plurality of first fluid openings.

2. The refrigerator appliance of claim 1, wherein the chilled chamber is a first chilled chamber, wherein the internal liner further defines a second chilled chamber spaced apart from the first chilled chamber, wherein the first end of the duct body is positioned proximal to the first chilled chamber, wherein the second end of the duct body is positioned proximal to the second chilled chamber, and wherein the fluid exchange path is defined in fluid communication between the first chilled chamber and the second chilled chamber.

3. The refrigerator appliance of claim 2, wherein the first chilled chamber is positioned above the second chilled chamber along a vertical direction.

4. The refrigerator appliance of claim 1, wherein the duct body and the plurality of resilient fingers comprise polypropylene.

5. The refrigerator appliance of claim 1, wherein the duct body further comprises a second opening at the second end in fluid communication with the fluid exchange path.

6. The refrigerator appliance of claim 1, wherein the plurality of first fluid openings at the first end are defined in parallel, and wherein the air duct further defines a plurality of parallel second openings at the second end.

7. The refrigerator appliance of claim 6, further comprising an intermediate wall extending from the duct body at the first end radially-inward from the plurality of resilient fingers.

8. The refrigerator appliance of claim 7, wherein the intermediate wall is positioned between two first openings of the plurality of first fluid openings.

9. The refrigerator appliance of claim 1, wherein the duct body defines an outer surface opposite the fluid exchange path, and wherein the refrigerator appliance further comprises a foam insulation positioned between the internal liner and the cabinet against the outer surface of the duct body.

10. The refrigerator appliance of claim 1, wherein the duct body further comprises a raised collar extending through the internal liner into the chilled chamber at the first end.

11. The refrigerator appliance of claim 1, wherein at least one finger of the plurality of resilient fingers extends to the internal liner at a non-parallel angle relative to an axial direction.

12. An air duct positionable within a refrigerator appliance to direct an airflow therethrough, the air duct comprising:

a duct body extending between a first end to a second end, the duct body defining a fluid exchange path between the first end and the second end, and a plurality of first fluid openings at the first end in fluid communication with the fluid exchange path; and a plurality of resilient fingers radially-spaced apart about the plurality of first fluid openings, the plurality of resilient fingers extending integrally from the duct body against an outer surface of an internal liner of the refrigerator appliance at the first end of the duct body, wherein the outer surface is defined outside of a chilled chamber defined by the internal liner, and wherein the plurality of resilient fingers are positioned radially outward from and completely surrounding the plurality of first fluid openings.

13. The air duct of claim 12, wherein the duct body and the plurality of resilient fingers comprise polypropylene.

14. The air duct of claim 12, wherein the duct body further comprises a second opening at the second end in fluid communication with the fluid exchange path.

15. The air duct of claim 12, wherein the plurality of first fluid openings at the first end are defined in parallel, and wherein the air duct further defines a plurality of parallel second openings at the second end.

16. The air duct of claim 15, further comprising an intermediate wall extending from the duct body at the first end radially-inward from the plurality of resilient fingers, wherein the intermediate wall is positioned between two first openings of the plurality of first fluid openings.

17. The air duct of claim 12, wherein the duct body further comprises a raised collar extending through the internal liner at the first end.

18. The air duct of claim 12, wherein at least one finger of the plurality of resilient fingers extends to the internal liner at a non-parallel angle relative to an axial direction.

19. The air duct of claim 12, wherein the first end of the duct body is positioned proximal to a first chilled chamber defined by the internal liner, wherein the second end of the duct body is positioned proximal to a second chilled chamber defined by the internal liner below the first chilled chamber, and wherein the fluid exchange path is defined in fluid communication between the first chilled chamber and the second chilled chamber.

20. A refrigerator appliance comprising:

a cabinet;

an internal liner positioned within the cabinet, the internal liner defining a chilled chamber; and an air duct comprising:

a duct body extending along an axial direction between a first end to a second end, the duct body defining a fluid exchange path between the first end and the second end, the duct body further defining a plurality of first fluid openings at the first end in fluid communication with the fluid exchange path, and a plurality of resilient fingers radially-spaced apart about the plurality of first fluid openings, the plurality of resilient fingers extending integrally from the duct body, wherein the plurality of resilient fingers extend against an outer surface of the internal liner at the first end of the duct body, wherein the outer surface is defined outside of the chilled chamber, wherein the plurality of resilient fingers are positioned radially outward from and completely surround the plurality of first fluid openings, and wherein at least one finger of the plurality of resilient fingers extends to the internal liner at a non-parallel angle relative to the axial direction.

* * * * *